US009263841B2

(12) United States Patent
Hwang et al.

(10) Patent No.: US 9,263,841 B2
(45) Date of Patent: Feb. 16, 2016

(54) SHIELDING ELECTRICAL CONNECTOR AND METHOD OF MAKING THE SAME

(71) Applicant: HON HAI PRECISION INDUSTRY CO., LTD., New Taipei (TW)

(72) Inventors: Tzu-Yao Hwang, New Taipei (TW); Yen-Chih Chang, New Taipei (TW); Ke-Hao Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/140,584

(22) Filed: Dec. 26, 2013

(65) Prior Publication Data

US 2014/0179160 A1 Jun. 26, 2014

(30) Foreign Application Priority Data

Dec. 26, 2012 (TW) ..... 101150265 A

(51) Int. Cl.

| | |
|---|---|
| ***H01R 43/24*** | (2006.01) |
| ***H01R 13/504*** | (2006.01) |
| ***H01R 13/6599*** | (2011.01) |
| ***H01R 43/18*** | (2006.01) |
| ***H01R 12/57*** | (2011.01) |
| ***H01R 13/24*** | (2006.01) |
| ***H01R 13/6588*** | (2011.01) |

(52) U.S. Cl.

CPC ..... *H01R 43/24* (2013.01); *H01R 13/504* (2013.01); *H01R 13/6599* (2013.01); *H01R 43/18* (2013.01); *H01R 12/57* (2013.01); *H01R 13/2421* (2013.01); *H01R 13/6588* (2013.01); *Y10T 29/49208* (2015.01)

(58) Field of Classification Search

CPC .... H01R 12/714; H01R 12/716; H01R 12/51; H01R 12/52; H01R 13/6588; H01R 13/6417; H01R 13/6585; H01R 13/648; H01R 13/658; H01R 13/6599; H01R 43/24

USPC ..... 439/607.05, 607.1, 607.02, 607.13, 66, 439/92

See application file for complete search history.

(56) References Cited

U.S. PATENT DOCUMENTS 6,533,613 B1 3/2003 Turner et al.
8,167,652 B1 * 5/2012 Ju ..... 439/607.13

(Continued)

FOREIGN PATENT DOCUMENTS

CN 102176559 A 9/2011
CN 202034574 U 11/2011

(Continued)

*Primary Examiner* — James Harvey
*Assistant Examiner* — Oscar C Jimenez
(74) *Attorney, Agent, or Firm* — Wei Te Chung; Ming Chieh Chang

(57) ABSTRACT

An electrical connector includes a seat having a signal contact receiving slot and a grounding contact receiving slot, and a signal contact and a grounding contact retained therein. The seat includes a first insulating member and a second insulating member surrounding the first insulating member, wherein the grounding contact receiving slot is defined on the first insulating member, the first insulating member further includes a through hole substantially parallel to the grounding contact receiving slot, a shielding member is defined on at least the inner surfaces of the grounding contact receiving slot and the through hole, the second insulating member includes a column formed into the through hole, the signal contact receiving slot is defined on the column of the second insulating member.

20 Claims, 5 Drawing Sheets

(56) References Cited

U.S. PATENT DOCUMENTS

| | | | | |
|---|---|---|---|---|
| 8,192,206 | B1 * | 6/2012 | Ju | 439/66 |
| 8,851,904 | B2 * | 10/2014 | Chang et al. | 439/71 |
| 8,969,734 | B2 * | 3/2015 | Murphy et al. | 174/260 |
| 2011/0159734 | A1 * | 6/2011 | Ju | 439/607.05 |
| 2013/0330969 | A1 * | 12/2013 | Avery et al. | 439/607.01 |
| 2014/0038465 | A1 * | 2/2014 | Chang et al. | 439/626 |
| 2014/0235103 | A1 * | 8/2014 | Mason et al. | 439/607.08 |

FOREIGN PATENT DOCUMENTS

| | | | |
|---|---|---|---|
| CN | 202067919 | U | 12/2011 |
| WO | WO2012119075 | A2 | 9/2012 |

* cited by examiner

SHIELDING ELECTRICAL CONNECTOR AND METHOD OF MAKING THE SAME

BACKGROUND OF THE INVENTION

1. Field of the Invention

The present disclosure relates to an electrical connector, and more particularly to a shielding electrical connector having an improved shielding effect and easy to be manufactured.

2. Description of the Related Art

Various electrical connectors are widely used in computer and other electronic devices. An electrical connector for electrically connecting a Central Processing Unit (CPU) to a Printed Circuit Board (PCB) typically comprises an insulating housing and a plurality of contacts retained therein. The contacts connect the CPU and the PCB so as to establish an electrical connection therebetween. However with rapid increasing of the amount and speed of the data transmitted by the contacts, the arrangement density of the contacts increases and the Electro Magnetic Interference (EMI) between the contacts becomes more and more serious. Therefore, an electrical connector with shielding member around the contacts is provided.

For example, U.S. Pat. No. 8,167,652 issued to Ju on May 1, 2012 discloses a shielding electrical connector. The electrical connector comprises an insulating body defining a plurality of receiving slots and a plurality of terminals received in the receiving slots, wherein a shielding body is formed on the inner surface of the receiving slot by physical-plating and an insulating paint layer is formed on the shielding body by immersing, spraying or coating to isolate the terminals and the shielding body. However as the insulating paint layer is formed on the shielding body by immersing, spraying or coating, the insulating paint layer is very thin and easy to be punctured by the terminal. While if the insulating paint layer is formed thicker, it affects the dimension of the receiving slot, and it is difficult for the assembling of the terminals.

In view of the above, an improved electrical connector is desired to overcome the problems mentioned above.

SUMMARY OF THE INVENTION

Accordingly, an object of the present disclosure is to provide an electrical connector having an improved shielding effect and easy to be manufactured.

In order to achieve the object set forth, an electrical connector comprising a seat having a signal contact receiving slot and a grounding contact receiving slot, and a signal contact and a grounding contact retained therein is provided. The seat comprises a first insulating member and a second insulating member surrounding the first insulating member, wherein the grounding contact receiving slot is defined on the first insulating member, the first insulating member further includes a through hole substantially parallel to the grounding contact receiving slot, a shielding member is defined on at least the inner surfaces of the grounding contact receiving slot and the through hole, the second insulating member includes a column formed into the through hole, the signal contact receiving slot is defined on the column of the second insulating member.

DESCRIPTION OF PREFERRED EMBODIMENT

Figure 1:
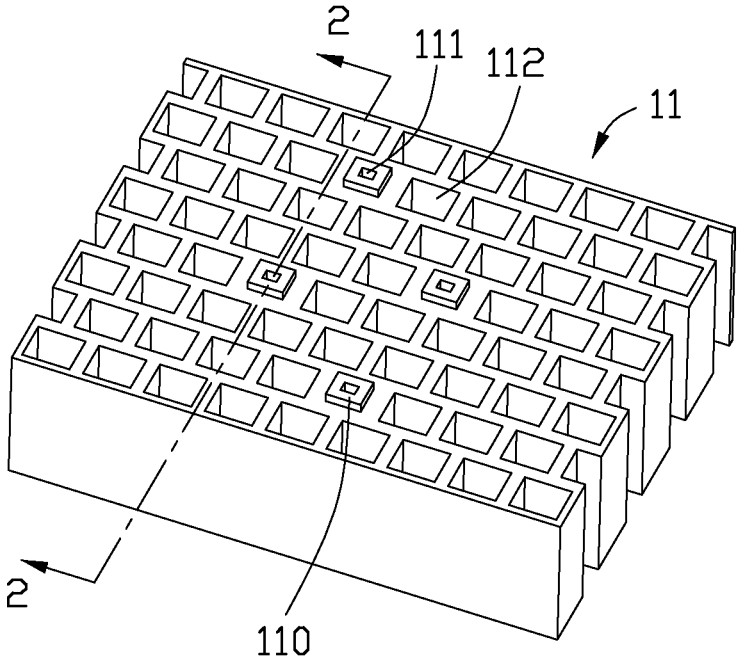
FIG. 1 is a perspective view of a first insulating member in accordance with a preferred embodiment of the present disclosure.
Figure 2:
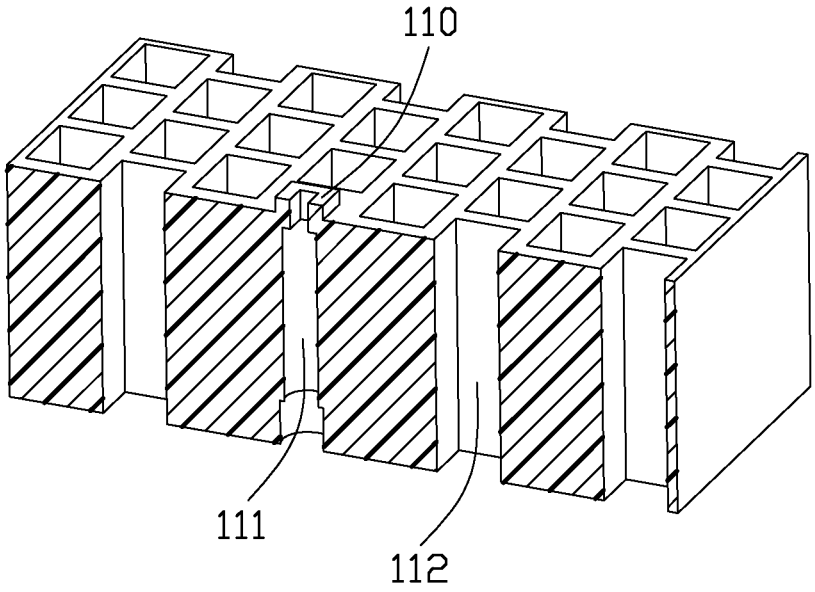
FIG. 2 is a perspective, sectional view of the first insulating member shown in FIG. 1 along line 2-2.
Figure 3:
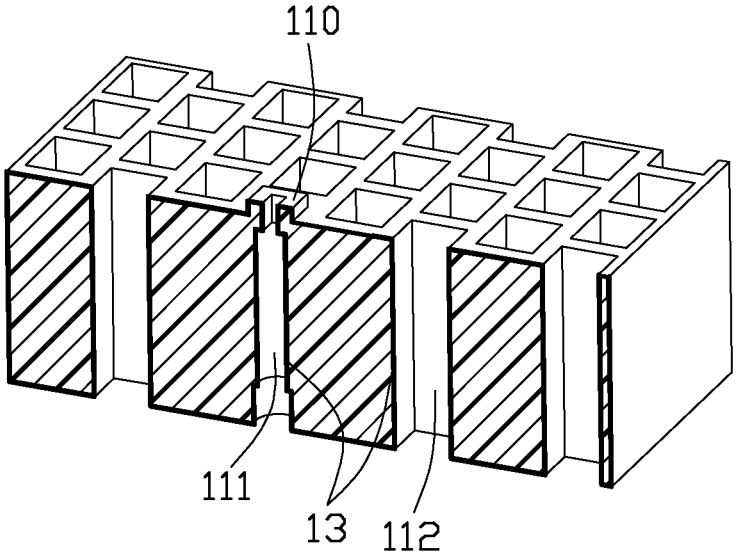
FIG. 3 is a view similar to the FIG. 2, wherein the first insulating member is coated by a shielding member.

Reference will now be made to the drawings to describe the present disclosure in detail.

FIGS. 1 to 5 show an electrical connector 100 in accordance with a preferred embodiment of the present disclosure. The electrical connector 100 comprises a seat 1, a plurality of signal contacts 3 retained in the seat 1, at least one grounding contact 2 retained in the seat 1, and a plurality of solder balls 4.

Figure 4:
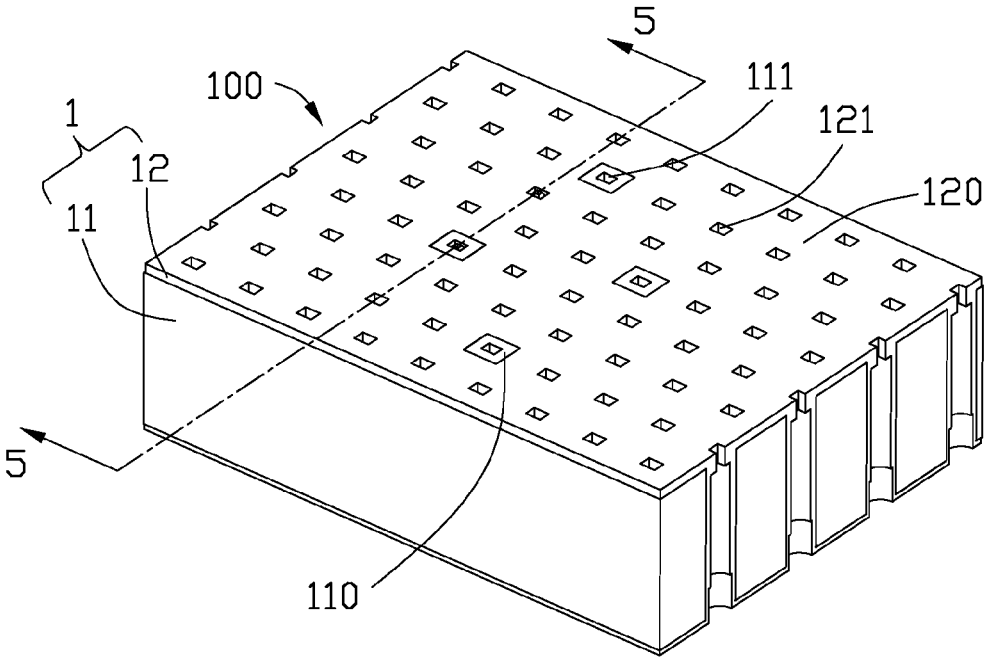
FIG. 4 is a perspective view of the electrical connector in accordance with the preferred embodiment of the present disclosure.
Figure 5:
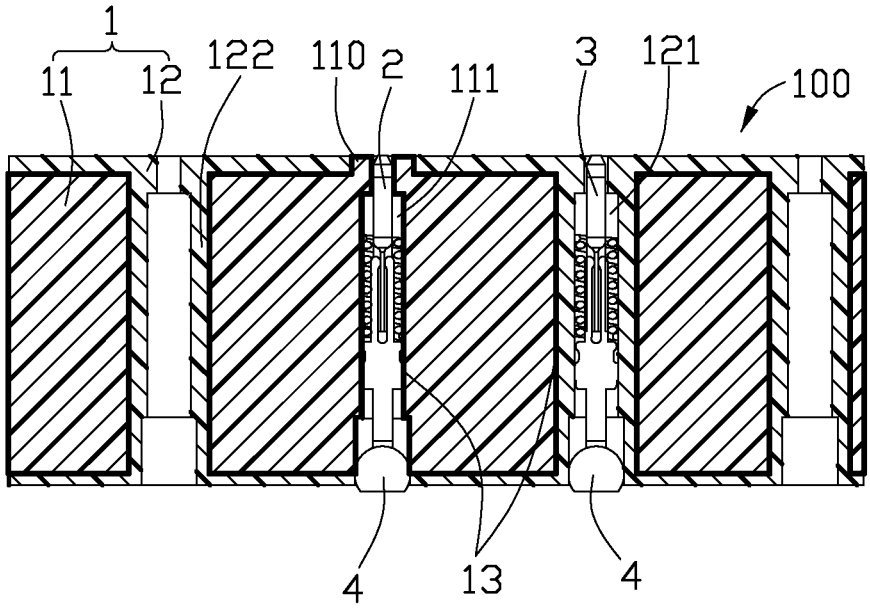
FIG. 5 is a cross sectional view of the electrical connector shown in FIG. 4 along line 5-5.

Referring to FIG. 4 and FIG. 5, the seat 1 comprises a first insulating member 11 and a second insulating member 12. The first insulating member 11 defines a plurality of grounding contact receiving slots 111 for receiving the grounding contact 2 and a plurality of through holes 112 surrounding the grounding contact receiving slots 111. The inner surfaces of the grounding contact receiving slots 111 and the through holes 112 are coated by shielding members 13. The second insulating member 12 is formed on the first insulating member 11 by injection molding process and comprises a plurality of columns 122 formed in the through holes 112 of the first insulating member 11. Each of the columns 122 comprises a signal contact receiving slot 121 for receiving the signal contact 3. The signal contact receiving slot 121 has the same structure with the grounding contact receiving slot 111 while the signal contact 3 is the same with the grounding contact 2 for non-distinctive assembling. The grounding contact 2 is received in the grounding contact receiving slot 111 and contacts the shielding member 13 while the signal contact 3 is received in the signal contact receiving slot 121 and disconnects the shielding member 13.

Referring to FIG. 1 to FIG. 4, the manufacturing process of the electrical connector 100 will be described as follows. Firstly, form the first insulating member 11 by first injection molding process. The first insulating member 11 comprises at least a grounding contact receiving slot 111 and a plurality of through holes 112. The dimension of the through hole 112 is larger than the dimension of the grounding contact receiving slot 111 in a horizontal direction. The first insulating member 11 comprises at least a protrusion 110 corresponding to the grounding contact receiving slot 111. Secondly, the first insulating member 11 is coated by the shielding member 13. The inner surface of the grounding contact receiving slot 111, the inner surface of the through holes 112 and other surfaces of the first insulating member 11 are coated by the shielding member 13. Thirdly, form the second insulating member 12 on the first insulating member 11 by second injection molding process. The second insulating member 12 is coated on the surface except the inner surface of the grounding contact receiving slot 111 of the first insulating member 11 and forms a top surface 120 of the seat 1. The top surface of the protrusion 110 and the top surface 120 of the seat 1 are coplanar. The second insulating member 12 comprises a plurality of columns 122 formed in the through holes 112 of the first insulating member 11. The column 122 being in a tubular form, comprises a signal contact receiving slot 121 for receiving the signal contact 3. Finally, assemble the grounding contact 2 and the signal contact 3 into the grounding contact receiving slot 111 and the signal contact receiving slot 121 correspondingly. The grounding contact 2 electrically contacts the shielding member 13 on the inner surface of the grounding contact receiving slot 111 while the signal contact 3 is isolated from the shielding member by the column 122.

In the preferred embodiment of the present disclosure as described above, the electrical connector 100 is formed by twice injection molding process and a plating process. The shielding member 13 is defined on at least the inner surface of the grounding contact receiving slot 111 and the inner surface of the through hole 112. The shielding member 13 defined on the inner surface of the through hole 112 surrounds the signal contact receiving slot 121 and isolates from the signal contact 3 by the column 122. Therefore, the signal contact 3 can be well shielded and the risk of shorting the shielding member 13 can be avoided. Alternately, another embodiment may have the second insulating member 12 be in a straight form and insert-molded or pre-assembled with the corresponding signal contact 3 as a sub-assembly and commonly inserted, in an interference fit, into the corresponding through hole 112, which is already coated with the shielding member 13, for finalize the whole connector assembly.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for electrically connecting a central processing unit (CPU) to a printed circuit board (PCB), comprising:

a signal contact;

a grounding contact; and a seat comprising at least a signal contact receiving slot and a grounding contact receiving slot spaced transversely and independently from each other, the seat comprising a first insulating member and a second insulating member surrounding the first insulating member; wherein the grounding contact receiving slot is defined in the first insulating member, the first insulating member further comprises a through hole substantially parallel to the grounding contact receiving slot, a shielding member is defined on at least the inner surfaces of the grounding contact receiving slot and the through hole, the second insulating member comprises a tubular column formed into the through hole, the signal contact receiving slot is defined in the column of the second insulating member, and wherein the grounding contact is received in the grounding contact receiving slot and contacts the shielding member while the signal contact is received in the signal contact receiving slot and isolated from the shielding member by the corresponding column; wherein the through hole is dimensioned transversely larger than the grounding contact receiving slot.

2. The electrical connector as claimed in claim 1, wherein the shielding member is formed by plating.

3. The electrical connector as claimed in claim 1, wherein the structure of the signal contact is the same with the grounding contact, the shape of the signal contact receiving slot is the same with the grounding contact receiving slot.

4. The electrical connector as claimed in claim 1, wherein the first insulating member comprises a protrusion corresponding to the grounding contact receiving slot, the shielding member is further defined on a top surface of the protrusion.

5. The electrical connector as claimed in claim 4, wherein the second insulating member forms a top surface of the seat, the top surface of the seat is coplanar with the top surface of the protrusion.

6. The electrical connector as claimed in claim 5, wherein the first insulating member is fully covered by the second insulating member except the top surface of the protrusion and the inner surface of the grounding contact receiving slot.

7. The electrical connector as claimed in claim 1, wherein the tubular column defines different thicknesses axially so as to compliantly receive the contour of the corresponding signal contact therein.

8. The electrical connector as claimed in claim 1, wherein the through hole defines a constant transverse dimension axially.

9. The electrical connector as claimed in claim 8, wherein the second insulating member is insert-molded within the first insulating member so as to form the different thicknesses axially of said tubular column.

10. A method for making an electrical connector, comprising the steps of:

forming a first insulating member by a first injection molding process, the first insulating member comprising a plurality of grounding contact receiving slots and a plurality of through holes transversely spaced independently from each other;

forming a shielding member onto the first insulating member by plating process, the shielding member defined on at least the inner surface of the grounding contact receiving slots and the inner surface of the through holes;

forming a second insulating member integrally on at least the shielding member of the through hole via a second injection molding process, the second insulating member comprising a plurality of tubular columns formed into the through holes of the first insulating member, each of the columns comprising a signal contact receiving slot;

assembling grounding contacts into the grounding contact receiving slots and signal contacts into the signal contact receiving slots, the grounding contacts connect the shielding member while the signal contact is isolated from the surrounding shielding member by the corresponding surrounding column; wherein each of the tubular columns defines different thicknesses axially to form the corresponding signal contact receiving slot so as to comply with an axially variant contour of the corresponding signal contact.

11. The method as claimed in claim 10, wherein the signal contact has the same structure with the grounding contact while the signal contact receiving slot has the same shape with the grounding contact receiving slot.

12. The method as claimed in claim 10, wherein the first insulating member comprises a protrusion corresponding to the grounding contact receiving slot, the shielding member is further defined on the protrusion.

13. The method as claimed in claim 12, wherein the second insulating member surrounds the first insulating member and forms a top surface, the protrusion of the first insulating member is coplanar with the top surface of the second insulating member.

14. The method as claimed in claim 10, wherein the through hole is dimensioned transversely larger than the grounding contact receiving slot.

15. The method as claimed in claim 14, wherein each of the through holes defines a constant diameter axially.

16. An electrical connector comprising:

a seat including a first insulating member and a second insulating member, said first insulating member defining a plurality of through holes extending therethrough in a vertical direction;

a shielding layer coated upon an interior surface of each of the through holes;

the second insulating member including a plurality of columnar bodies each with a corresponding signal contact disposed into the corresponding through hole and upon the corresponding coated interior surface of the corresponding through hole; wherein each of said columnar bodies defines a tubular structure in the corresponding through hole, and a thickness of said tubular structure is dimensioned much larger than a so-called layer by coating for efficiently holding the corresponding signal contact therein; wherein each of the columnar bodies is discrete from the corresponding signal contact which is inserted thereinto after the corresponding columnar body has been integrally formed on the corresponding shielding layer via an injection molding process.

17. The electrical connector as claimed in claim 16, wherein the first insulating member further includes a plurality of grounding contact receiving slots, which are transversely and independently spaced from said through holes, with said shielding layer coated upon an interior surface of each of said grounding contact receiving slots, and a plurality of grounding contacts are disposed in the corresponding grounding contact receiving slots, respectively.

18. The electrical connector as claimed in claim 17, wherein the through hole is dimensioned transversely larger than the grounding contact receiving slot.

19. The electrical connector as claimed in claim 16, wherein each of the columnar bodes defines different thicknesses axially to comply with an axially variant contour of the corresponding signal contact.

20. The electrical connector as claimed in claim 19, wherein the first insulating member further defines a plurality of protrusions upon the corresponding grounding contact receiving slots, respectively, and the second insulating member forms a top face coplanar with said protrusions.

* * * * *